US005211290A

United States Patent [19]

Janus et al.

[11] Patent Number: 5,211,290

[45] Date of Patent: May 18, 1993

[54] SUSPENSION PACKAGE AND SYSTEM

[75] Inventors: James J. Janus, Calumet City; Richard L. Zidek, Chicago; Lewis C. Lofgren, Oak Park, all of Ill.

[73] Assignee: ADE, Inc., Chicago, Ill.

[21] Appl. No.: 927,350

[22] Filed: Aug. 10, 1992

[51] Int. Cl.[5] ..... B65D 81/00

[52] U.S. Cl. ..... 206/583

[58] Field of Search ..... 220/9.3; 206/264, 472, 206/528, 583

[56] References Cited

U.S. PATENT DOCUMENTS

| | | | |
|---|---|---|---|
| 2,598,136 | 5/1952 | Schmitz | 206/583 X |
| 2,696,322 | 12/1954 | Densen | 206/583 X |
| 2,837,208 | 6/1958 | Lingenfelter | 206/583 |
| 2,865,499 | 12/1958 | Brogen | 206/583 X |
| 3,388,792 | 6/1968 | Jones | 206/583 X |
| 3,552,595 | 1/1971 | Gerner | 206/16 |
| 3,752,301 | 8/1973 | Bluemel | 206/583 |
| 3,853,220 | 12/1974 | Luray | 206/583 X |
| 3,876,812 | 4/1975 | Peters | 426/113 |
| 4,019,637 | 4/1977 | Kurtz | 206/418 |
| 4,027,794 | 6/1977 | Olson | 206/395 |
| 4,685,571 | 8/1987 | Hoss | 206/583 |
| 4,903,827 | 2/1990 | Phelps et al. | 206/204 |
| 5,056,665 | 10/1991 | Boecker et al. | 206/583 |

*Primary Examiner*—Steven M. Pollard

*Attorney, Agent, or Firm*—Willian Brinks Olds Hofer Gilson & Lione

[57] ABSTRACT

A suspension package includes a frame having an upper part and lower part. The lower part has four corner posts and at least one bay defining element that is hinged to the corner posts to move between an operational position and a storage position. The bay defining element includes at least one flexible suspension sheet that extends across bays defined by the element. The upper part includes at least one upper flexible suspension sheet, and is mounted to move between an open position, in which the bays are exposed to allow a product to be inserted into and removed from the bay, and the closed position, in which the suspension sheets suspend the product within the frame. A tensioning device releasably holds the upper part in the closed position and tensions the suspension sheets. The package is preferably used with a collapsible enclosure.

45 Claims, 6 Drawing Sheets

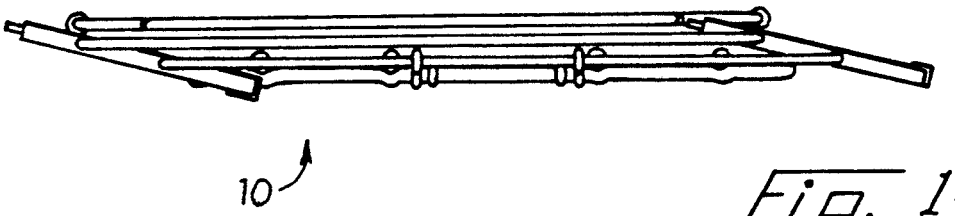
Fig. 14
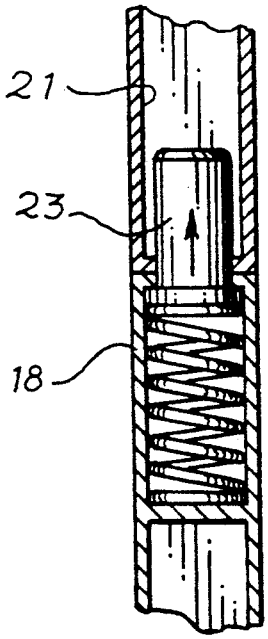
Fig. 6
Fig. 6A
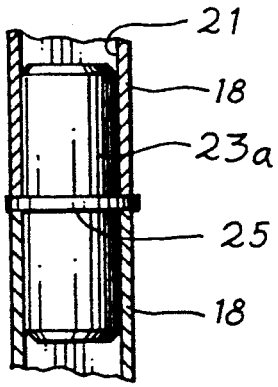
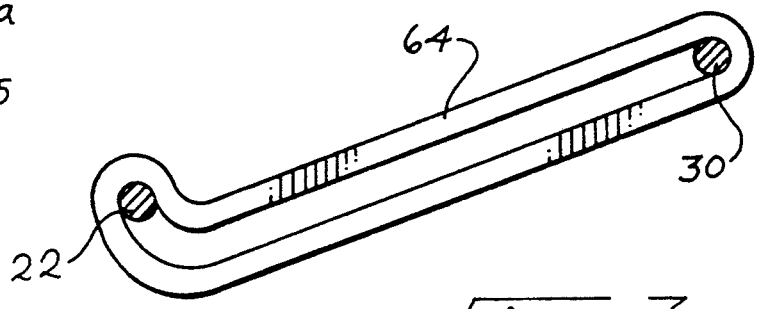
Fig. 7

SUSPENSION PACKAGE AND SYSTEM

BACKGROUND OF THE INVENTION

This invention relates to suspension packages, and particularly to a suspension package that can be collapsed to a reduced volume when not in use.

A wide variety of suspension packages are now in use to protect products in shipment and storage. Boecker U.S. Pat. No. 5,056,665, assigned to the assignee of the present invention, discloses a suspension package which utilizes an internal frame disposed within an outer container. A flexible hammock is tensioned across the frame, and the tension of the hammock can be increased to suspend the packaged article within the frame.

Phelps U.S. Pat. No. 4,903,827, also assigned to the assignee of the present invention, discloses a suspension package adapted for use with multiple similar articles. This package includes a lower part that defines respective wells, with a suspension film secured over the wells. The package also includes an upper part that is hinged to the lower part and carries an upper film. When the two parts are closed together, the articles being packaged are suspended between the upper and lower films over respective ones of the wells.

It is an object to this invention to provide an improved suspension package that is strong, rigid, and well suited for reuse, and that can readily be designed for shipping products in a wide range of weights and sizes. It is another object to provide a suspension package that be used to ship multiple products or single products. It is another object to this invention to provide such a suspension package which can readily be folded from an operational position to a storage position in order to reduce the space requirements of the package when it is not loaded with products.

SUMMARY OF THE INVENTION

According to a first aspect of this invention, a suspension package is provided comprising a frame which includes upper and lower portions. The lower portion includes a plurality of spacer elements and at least one bay defining element hingedly mounted to the spacer elements to move between an operational position, in which the spacer elements extend away from the bay defining element to create a product receiving space, and a storage position, in which the spacer elements extend generally alongside the bay defining element. The bay defining element defines a plurality of bays, and it includes at least one lower suspension sheet that extends across the bays to define a product receiving area in each bay when the spacer elements are in the operational position. The upper portion includes at least one upper suspension sheet, and is movable between an open position, in which at least one of the bays is exposed to allow a product to be inserted into and removed from the bay, and a closed position, in which the upper and lower suspension sheets are positioned to suspend the product within the frame. A tensioning device is secured to the frame to releasably hold the upper portion in the closed position.

According to a second aspect of this invention, a reusable, renewable suspension package system is provided comprising a collapsible enclosure that is movable between an operational position, in which the enclosure defines an internal volume, and a storage position, in which the enclosure is collapsed to reduce storage and shipping volume. A plurality of suspension packages are disposed within the enclosure, and each of the suspension packages comprises a frame that is movable between an operational position, in which the frame defines at least one product receiving volume, and a storage position, in which the frame is collapsed to reduce storage and shipping volume. The frame comprises first and second portions, and at least one flexible suspension sheet is secured to the frame. The first portion is movable between an open position, in which the suspension sheet is exposed to allow a product to be placed on the suspension sheet, and a closed position, in which the at least one suspension sheet is tensioned to suspend the product within the frame. A tensioning device is secured to the frame to releasably hold the first portion in the closed position and to tension the suspension sheet.

According to a third aspect of this invention, the suspension system described above is used to ship products and to reuse shipping materials by first placing a plurality of products in a plurality of the suspension packages of the type described above in connection with the suspension system. The tensioning devices are then operated to suspend the products in the suspension packages, and the suspension packages and the products suspended therein are then loaded in the collapsible enclosure described above. The collapsible enclosure and the suspension packages loaded therein are then shipped to a first location, and the suspension packages are then removed from the collapsible enclosure and the products are removed from the suspension packages. Then the enclosure and the suspension packages are collapsed to the storage positions and shipped in their collapsed storage positions to another location for reuse.

According to a fourth aspect of this invention, an improvement is provided to a suspension package of the type comprising a frame comprising upper and lower portions, at least one suspension sheet positioned across the upper and lower portions to suspend the product, and a tensioning device secured to the frame to releasably hold the upper portion in position to tension the suspension sheet around the product. According to this invention, a preformed aperture is formed in the suspension sheet positioned to receive a protruding portion of the product and thereby to protect the protruding portion from applied suspension forces transmitted by the suspension sheet.

BRIEF DESCRIPTION OF THE DRAWINGS

FIG. 6 is an enlarged cross-sectional view of one of the corner posts of the suspension package of FIG. 1 engaged in the lower end of a similar corner post of a second, similar suspension package.

FIG. 6*a* is an enlarged cross sectional view that is similar to FIG. 6 and shows an alternate arrangement.

FIG. 7 is a fragmentary sectional view showing the configuration of the triangulating brace of the suspension package of FIG. 1.

FIG. 14 is a side view of the suspension package of FIG. 1 in the fully collapsed position.

DETAILED DESCRIPTION OF THE PRESENTLY PREFERRED EMBODIMENTS

Figure 1:
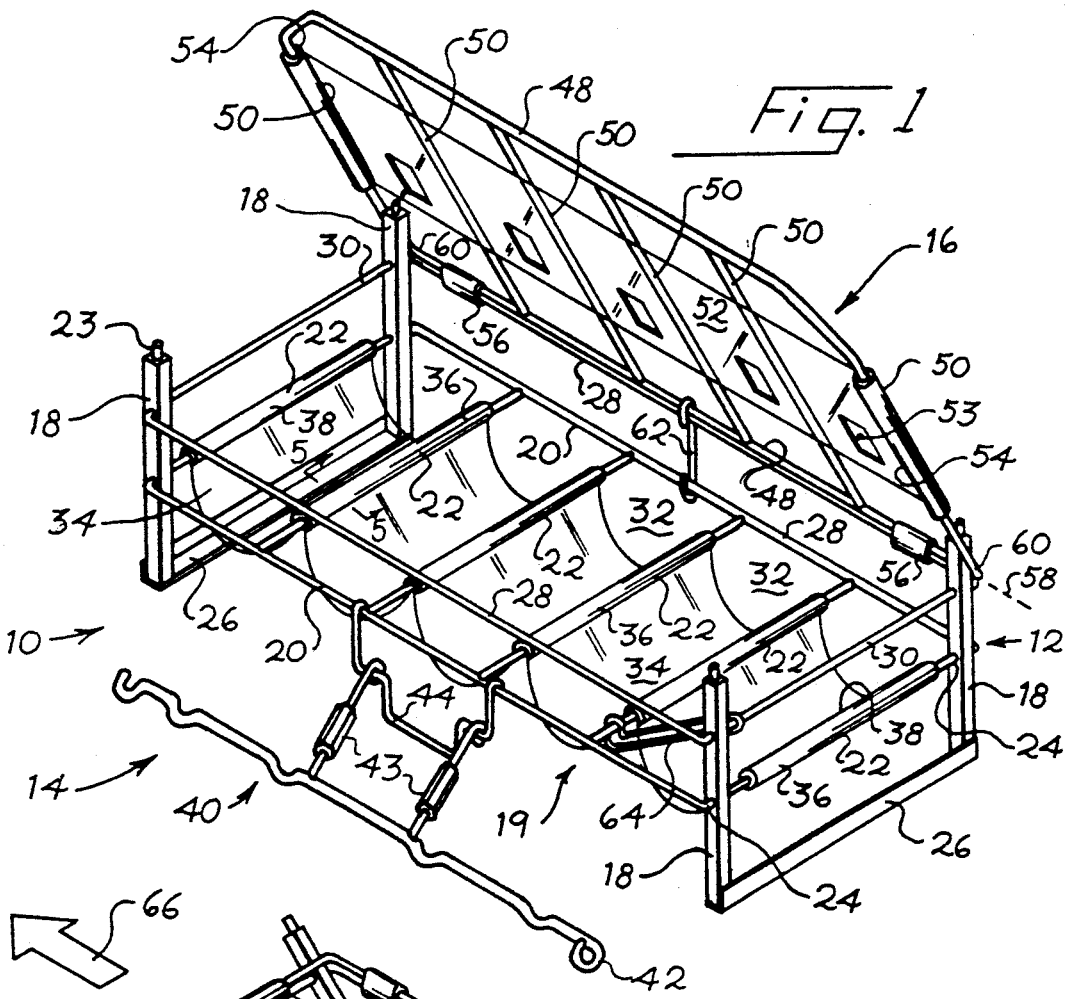
FIG. 1 is a perspective view of a suspension package which incorporates a first preferred embodiment of this invention.
Figure 2:
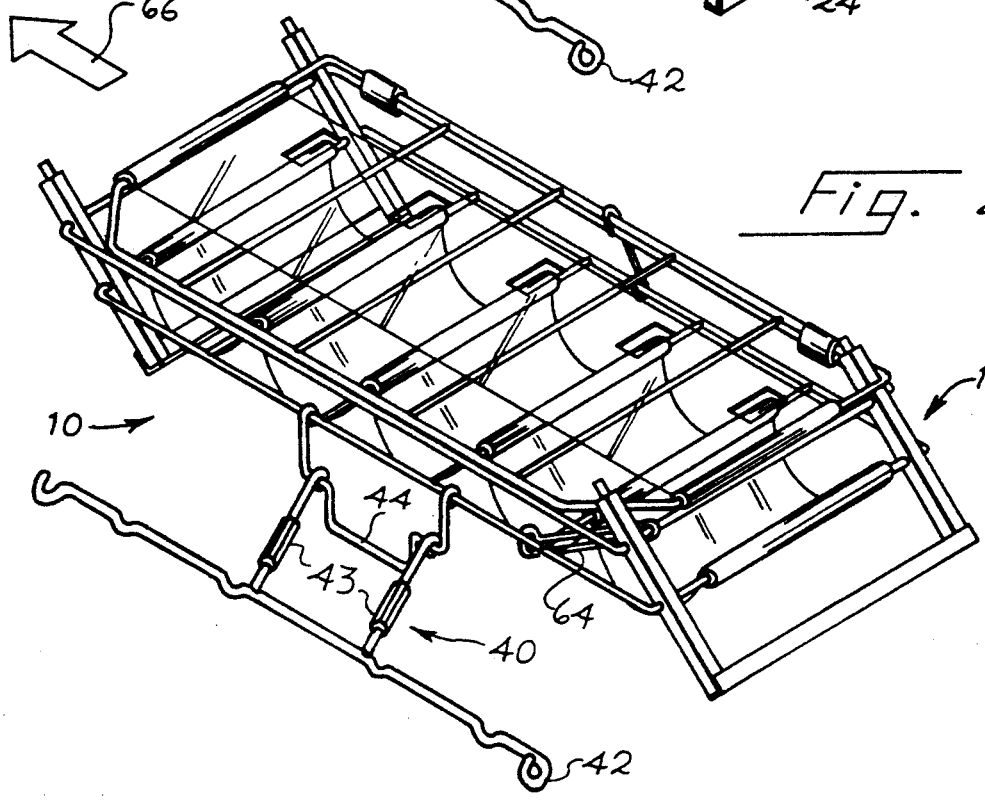
FIG. 2 is a perspective view showing the package of FIG. 1 partly collapsed, with the upper portion in the closed position.

Turning now to the drawings, FIGS. 1–7 show various views of a suspension package 10 which incorporates a first preferred embodiment of this invention. The suspension package 10 includes a frame 12 that in turn includes a lower portion 14 and an upper portion 16.

The lower portion 14 includes four corner posts 18 which function as spacer elements as described below. The corner posts are interconnected by a bay defining element 19 that is made up of two spaced, parallel side bars 20 which are interconnected by spaced, parallel transverse bars 22. The two outermost transverse bars 22 pass through respective openings in the corner posts 18 to form hinges 24. These hinges define respective hinge axes which are aligned with the outermost ones of the transverse bars 22. In practice, the side bars 20 may be formed integrally with the outermost transverse bars 22 as two U shaped elements which are welded together near the centers of the transverse bars 22. The lower portion 14 also includes a pair of load spreading bars 26 which are fixed to the lower ends of respective ones of the corner posts 18 and an upper brace comprising upper side braces 28 and upper transverse braces 30. The load spreading bars 26 provide a relatively large load bearing surface for the package 10, and they allow the package to slide easily across work surfaces in storage and manufacturing operations. The upper transverse braces 30 pass through openings in the corner posts 18 to define hinge axes aligned with the upper transverse braces 30.

Figure 5:
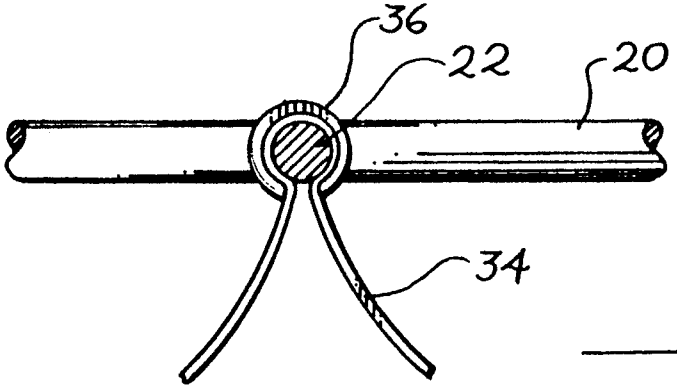
FIG. 5 is a detail sectional view taken along line 5—5 of FIG. 1.

The bay defining element 19 defines a plurality of bays 32, five in this embodiment. A flexible lower suspension sheet 34 is mounted to the bay defining element 19 to extend across the bays 32 as shown in FIG. 1. The lower suspension sheet 34 is preferably held in place to the transverse bars 22 by split sleeves 36, as best shown in FIG. 5. The split sleeves 36 preferably snap into position over the transverse bars 22 to maintain the desired configuration for the lower suspension sheet 34 in each of the bays 32. In this way, the lower suspension sheet 34 cooperates with the lower portion 14 of the frame 12 to define five product receiving areas, one associated with each of the bays 32. The split sleeves 36 can be formed of any suitable material, including metals and appropriate polymers. The split sleeve can be formed to shape, and if polymeric can be either extruded or slit from a tube. A wide variety of materials are suitable, but a plastic such as polypropylene is presently preferred.

As best shown in FIG. 1, a tensioning device which includes a latch 40 is mounted to the bay defining element 19, and this latch 40 includes a catch 42 which is hingedly secured to a handle 44. The handle 44 and the catch 42 are configured as an overcenter linkage, and the catch 42 is configured to engage the upper portion 16 of the frame 12. The catch 42 is provided with turnbuckles 43 that allow the effective length of the catch 42 to be adjusted.

Figure 4:
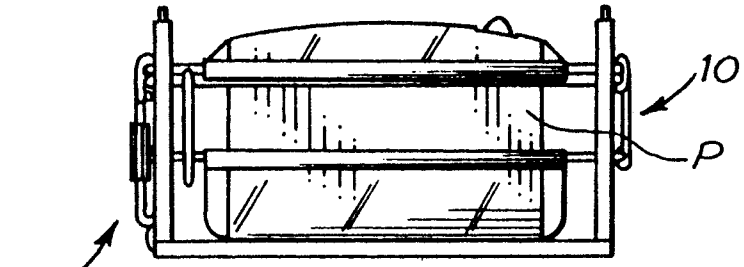
FIG. 4 is a side view of the suspension package of FIG. 1 showing the upper portion in the closed position.

As best shown in FIG. 1, the upper portion 16 is a substantially rigid, generally planar element made up of two spaced, parallel side bars 48 and a plurality of interconnecting transverse bars 50. The transverse bars 50 are arranged to overlie the transverse bars 22 when the upper portion 16 is in the closed position, as shown in FIG. 4. A flexible upper suspension sheet 52 extends across the transverse bars 50, on the underside of the upper portion 16. The upper suspension sheet 52 defines two opposed ends 54 which are secured to the outermost transverse bars 50 as described above.

As shown in FIG. 1, two hinges 56 interconnect the rearward one of the side bars 48 of the upper portion 16 with the rearward one of the upper side braces 28 of the lower portion 14. The hinges 56 allow the upper portion 16 to pivot about a hinge axis 58 between an open position as shown in FIG. 1 and a closed position as shown in FIG. 4. The rear corners 60 of the upper portion 16 are shaped to fit over the upper portions of the rear corner posts 18 when the upper portion 16 is the closed position of FIG. 4. A slidable clip 62 prevents the interconnected side bar 48 upper side brace 28 and lower side bar 20 from separating under load. Preferably, the hinges 56 are configured to allow the upper portion 16 to translate along the hinge axis 58 with respect to the lower portion 12 in order to facilitate collapse of the lower portion 12.

A triangulating brace 64 is captured on the lower portion 14 and can be hooked in position as shown in FIG. 1 to retain the lower portion 14 in the operational position shown in FIG. 1. The triangulating brace 64 in this embodiment is loop shaped, and is preferably configured as shown in FIG. 7 such that it automatically falls into position to hold the corner posts 18 in the operational position. When it is desired to collapse the lower portion 14, the triangulating brace 64 is merely raised along with the upper portion 16 to allow the lower portion 14 to collapse in a single, preferred direction, while preventing collapse in the reverse direction. The triangulating brace 64 may be positioned at the rear of the package if desired.

In the operational position, the corner posts 18 extend transversely to the bay defining element 19 so as to define a product receiving space within the lower portion 14. The catch 42 is preferably indented as shown to allow it to nest compactly with the collapsed lower portion 14, but such indents are not required for all applications.

In order to facilitate stacking of the suspension package 10 with other similar suspension packages 10, each of the corner posts 18 defines a protruding interlocking element 23 at one end and a recessed interlocking element 21 at the other, as best shown in FIG. 6. In FIG. 6 the protruding interlocking element 23 is configured as a solid rod which is spring loaded to an extended position in the upper end of the corner post 18. The recessed interlocking element 21 is configured as a mating socket in the lower end of the corner post 18. FIG. 6 shows the protruding interlocking element 23 of a lower suspension package fitted into the recessed interlocking element 21 of an upper suspension package which is stacked on the lower suspension package. In this way, the suspension packages can readily be stacked in a stable configuration. The uppermost suspension package in the stack does not occupy an unnecessarily large amount of space, because the spring loaded protruding interlocking elements 23 can be depressed into the corner posts 18 when necessary.

FIG. 6*a* shows an alternate arrangement in which the protruding interlocking element 23*a* is fixedly positioned in the top of the lower corner post 18 of the lower suspension package. The element 23*a* is formed of a resilient material such as nylon, and preferably includes a flange 25 that is interposed between the two corner posts 18 to reduce chipping and to provide some cushioning.

The suspension package 10 can readily be adjusted to operate properly with products of varying sizes and shapes. Small adjustments can be made by adjusting the effective length of the catch 42 with the turnbuckles 43 to provide the desired degree of tension on the suspension sheets 34, 52. Larger adjustments can be made by varying the length of the suspension sheets 34, 52 to match the product being shipped. This can easily be done by removing the respective split sleeves 36, positioning the suspension sheets 34, 52 as desired, and reattaching the split sleeves 36. With the configuration shown, some of the bays can be configured to receive a larger product, while others are configured to receive a smaller product.

Further adjustment can be obtained by properly selecting the material used for the suspension sheets 34, 52. For example, the lower suspension sheet 34 can if desired be made from a nonstretch material such as nylon in order to define the lowermost position of the packed products precisely. Also, the stretchability of the suspension sheets 34, 52 can be selected as appropriate for the product being shipped. For example, in the embodiment described above the preferred suspension sheet is a polyurethane film such as that marketed by Stevens as thermoplastic polyurethane film MP-1495, having a thickness of 6 mils. When a lighter product is being shipped the thickness of the film can be reduced into 1 to 2 mils for example. Conversely, heavier products may make thicker films appropriate.

In use, the lower portion 14 is oriented in the operational position shown in FIG. 1 and the upper portion 16 is raised to the open position shown in FIG. 1. Then products P to be shipped, stored or protected are placed in individual bays 32 on the lower flexible suspension sheet 34. Once the products P are properly in place, the upper portion 16 is lowered and the catch 42 is engaged on the forward side bar 48. Then the handle 42 is used to move the upper portion 16 to the closed position shown in FIG. 4, to tension the suspension sheets 34, 52 and to lock the upper portion 16 in this position with the overcenter latching linkage.

The overcenter latch mechanism including the catch 42 and the handle 44 provides a lever that allows high closing forces to be applied to the upper portion 16 to tension the suspension sheets 34, 52. Because the frame 12 defines multiple bays, products can be efficiently shipped and stored.

When fully closed, the suspension package 10 provides excellent protection for the product P against shock, vibration and surface abrasion. Because the frame 12 is formed of rigid components, it is well suited for shipping and storing heavy products. The suspension package described above has been designed to ship air bag modules weighing 5–10 pounds, this package can be altered to accomodate products that weigh much more than this. Note that when the upper portion 16 is in the closed position as shown in FIG. 4, the product P is supported on the sides and the bottom by the lower suspension sheet 32, and on the ends and the top by the upper suspension sheet 52. Furthermore, the frame 12 is reusable and is preferably formed of durable components. The suspension package 10 is preferably formed of rigid materials such as steel rod for the various bars and braces and steel channel for the corner posts 18. When in the operational position shown in FIG. 1, the corner posts 18 operate as spacer elements, and they facilitate stacking and shipping of the suspension package 10 in a conventional container.

Once the suspension package 10 has been emptied, it can be collapsed simply by lifting the triangulating brace 64, opening the upper portion 16, and collapsing the entire package 10 in the direction of the arrow 66 (FIG. 1) to orient the corner posts 18 generally alongside the bay defining element 19. In this particular example, the ratio of the volume of the suspension package 10 in the operational position to the collapsed position is greater than 3 to 1. This collapsibility is obtained without loose parts which can be lost.

Perhaps the most easily damaged parts of the suspension package 10 are the suspension sheets 34, 52, but these sheets can easily be replaced simply by removing the split sleeves 36 and attaching replacement sheets. Preferably, the suspension sheets 34, 52 should be formed of a material which is tough, non abrasive, transparent, nontransferring, chemically inert, and nonsticking, which does not tend to tear when punctured, and which has a high coefficient of friction. The polyester polyurethane film described above has been found suitable.

In some applications, the product being shipped may define protruding elements that are subject to damage by contact with the tensioned suspension sheets 34, 52. Such products can be accommodated by preforming (as for example by die cutting) apertures in the suspension sheets 34, 52 to allow the protruding elements to pass through the suspension sheets 34, 52 and thereby isolate such protruding elements from suspension forces. An example of such a precut aperture 53 is shown in FIG. 1.

Figure 8:
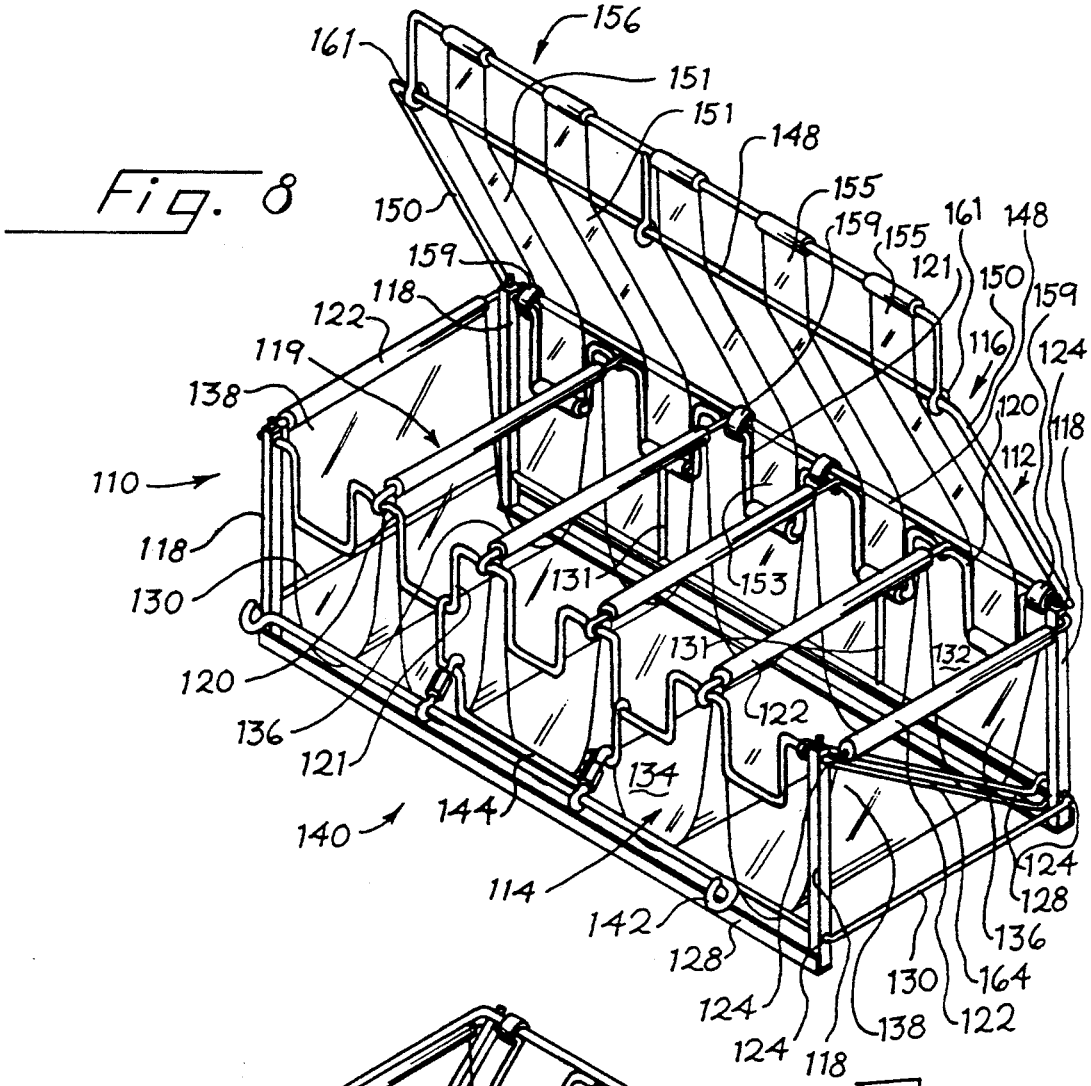
FIG. 8 is a perspective view of a second preferred embodiment of the suspension package of this invention.

FIGS. 8–11 illustrate a second preferred embodiment 110 of the suspension package of this invention. The second preferred embodiment includes a frame 112 having a lower portion 114 and an upper portion 116. The lower portion 114 defines corner posts 118 and a bay defining element 119. The bay defining element 119 includes side bars 120 and transverse bars 122. In this embodiment the side bars 120 define recesses as shown in FIG. 8, and the side bars 120 are rigidly secured to the respective corner posts 118. In this embodiment the transverse bars 122 are pivotably connected to the side bars 120, as for example with a hook and loop configuration as shown in FIG. 8. The transverse bars 122 are thus connected to the side bars 120 by respective hinges 124.

The lower portion 114 also includes load spreading bars 128 rigidly secured to the corner posts 118 and lower transverse braces 130 hingedly secured to the corner posts 118. Rods 131 extend between the side bars 120 and the load spreading bars 128 to rigidify the structure.

The bay defining element 119 defines five bays 132 oriented generally as discussed above in conjunction with the first preferred embodiment. A lower suspension sheet 134 extends across the bays 132 and is held in place by split sleeves 136 as discussed above. A tensioning device comprising a latch 140 having a catch 142 and an overcenter handle 144 (and all as described above) are also included.

As best shown in FIG. 8, the upper portion 116 comprises two spaced, parallel side bars 148 which are interconnected by spaced, parallel transverse bars 150. A plurality of upper suspension sheets 151 are provided, each having first and second ends 153, 155. The first ends 153 are secured to the lower portion of the recesses defined by the rear side bar 120. The second ends 155 are secured to the free edge of a lip 156 which is hingedly secured to the forward side bar 148.

The upper portion 116 is connected to the lower portion 114 by hinges 159, and the lip 156 is connected to the forward side bar 148 by hinges 161. A triangulating brace 164 can be used as shown in FIG. 8 to brace the frame 12 in the operational position, and once the triangulating brace 164 is lifted the lower portion 114 can be collapsed in the direction of the arrow 166 by virtue of the hinged connection between the transverse bars 122 and the lower transverse braces 130 on the one hand and the corner posts 118 on the other hand.

The suspension package 110 is used in a similar manner to the suspension package 10 described above and it provides substantially all of the same advantages. In particular, when the suspension package 110 is to be used, the lower portion 114 is braced in the operational position shown in FIG. B, and the upper portion 116 is moved to the open position as shown in FIG. 8, thereby exposing the bays 132. Products P are then loaded into the bays 132 and are supported by the lower suspension sheet 134. Once the products P are loaded, the upper portion 114 is moved to the closed position shown in FIG. 11 and is latched in the closed position by the tensioning device including the latch 140. In the closed position the upper suspension sheets 151 wrap around the products P at both the front and the back of the suspension package 110, because of the attachment points of the first and second ends 153, 155 at the bottom of the recesses. Thus, the upper suspension sheets 151 support the product at the top and ends, while the lower suspension sheet 134 supports the product at the bottom and sides.

Figure 9:
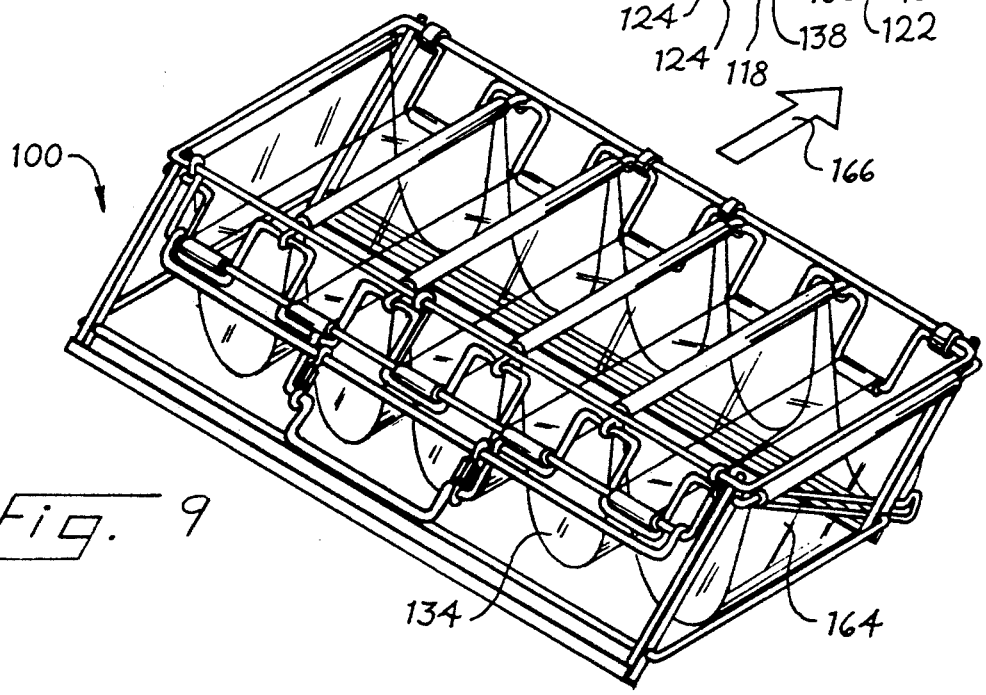
FIG. 9 is a perspective view of the package of FIG. 8 in the partly collapsed position with the upper portion closed.
Figure 11:
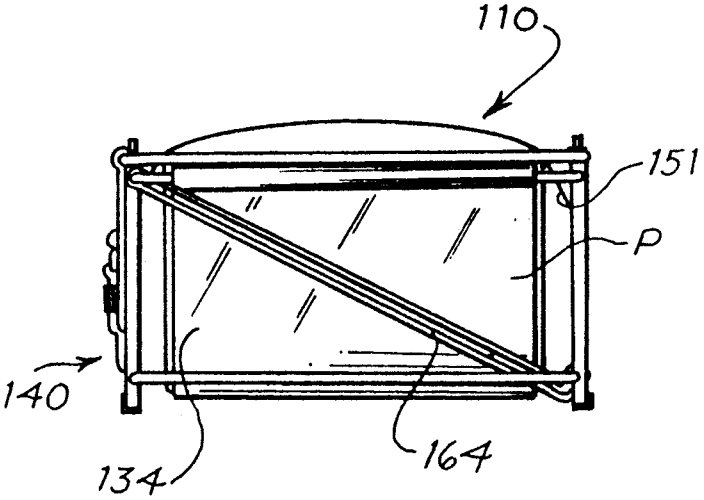
FIG. 11 is a side view of the suspension package of FIG. 8 showing the upper portion in the closed position.
Figure 10:
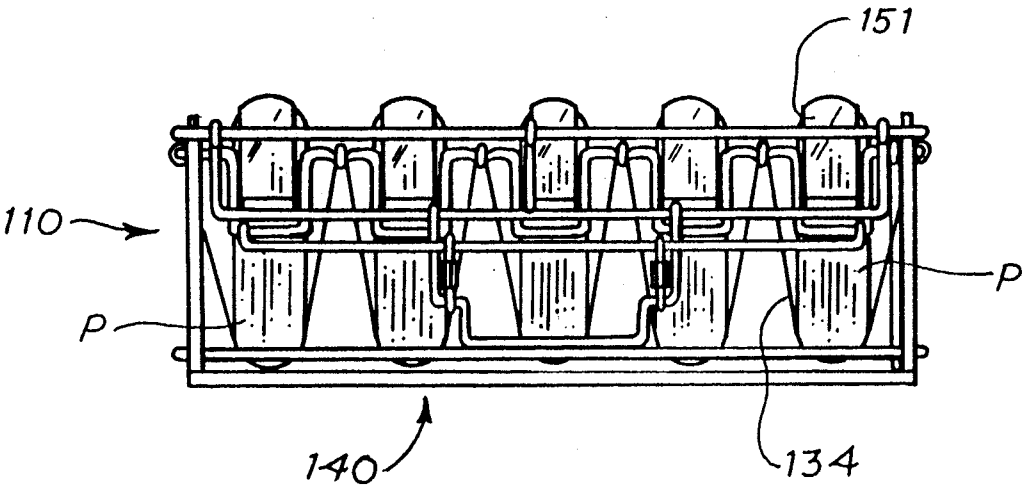
FIG. 10 is a front view of the suspension package of FIG. 8 showing the upper portion in the closed position.

After the suspension package 110 has been unloaded it can be collapsed by lifting the lower end of the triangulating brace 164 and then collapsing the lower portion 114 in the direction of the arrow 166 toward a storage position as shown in FIG. 9. Once again the storage position has a significantly reduced volume as compared to the operational position.

Figure 12:
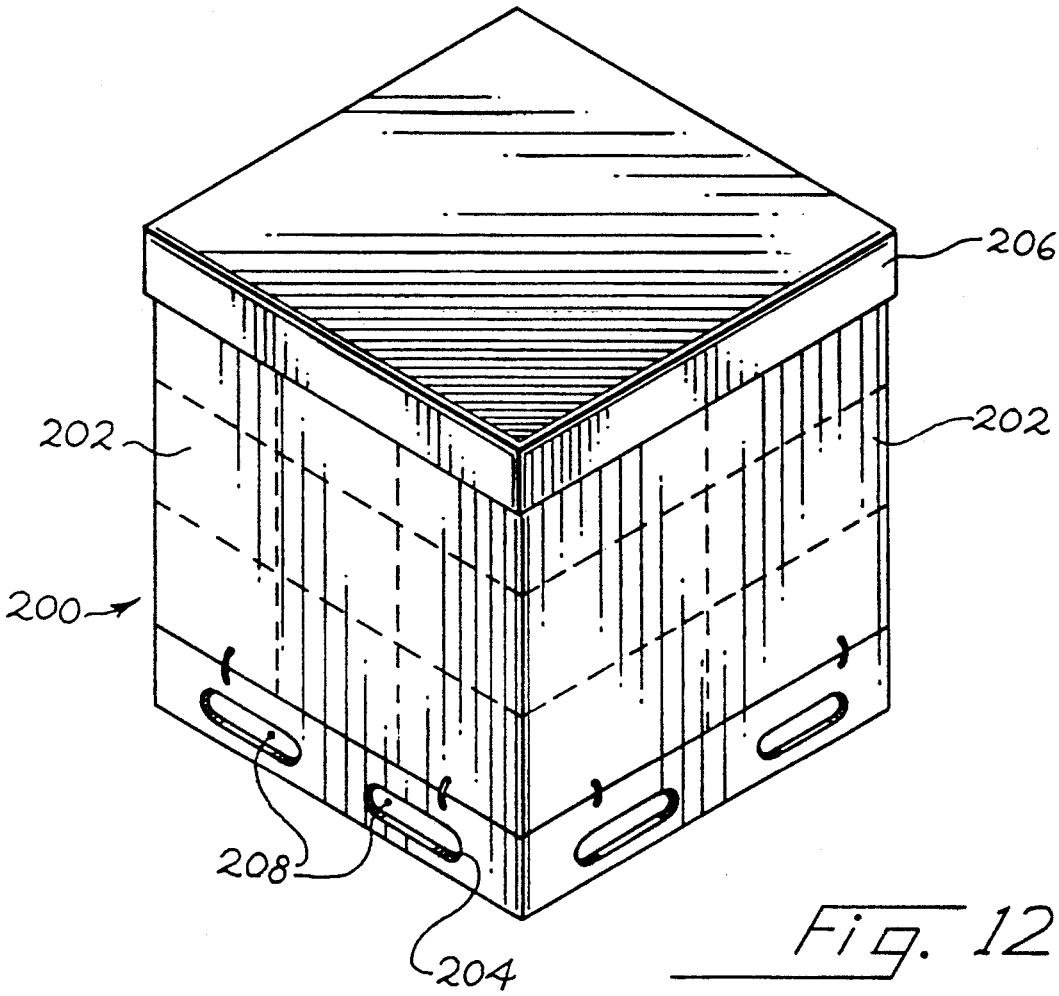
FIG. 12 is a side view of a collapsible enclosure containing eighteen of the suspension packages of FIG. 1 arranged in three layers, each layer having two rows of suspension packages, each row having three suspension packages.

The suspension packages 10, 110 described above can be used in a system that is reusable, recyclable and renewable. Preferably, this system includes a collapsible enclosure such as the enclosure 200 shown in FIG. 12. This enclosure includes sidewalls 202, a base 204 and a lid 206. The base 204 preferably includes openings 208 positioned to receive the forks of a forklift. In this embodiment, the enclosure 200 is sized to receive eighteen of the suspension packages 10, 110 arranged in three layers, each layer including two rows of suspension packages 10, 110, each row including three suspension packages. The layers are stacked one on top of the other as shown in FIG. 12.

Figure 13:
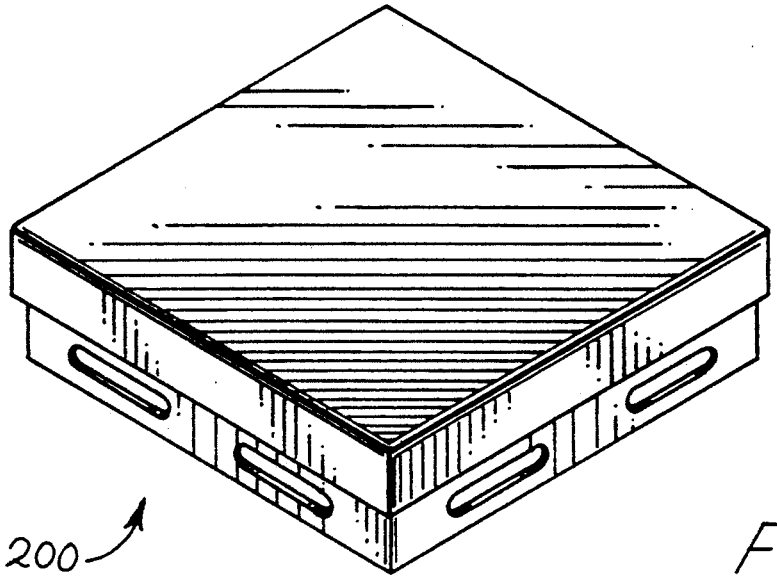
FIG. 13 is a side view of the collapsible enclosure of FIG. 12 in the collapsed position.

The enclosure 200 can be collapsed when empty as shown in FIG. 13 to reduce shipping volume. A suitable collapsible enclosure 200 can be obtained, for example, from World Container Corporation under the tradename Keeper IV. Of course, other collapsible containers can be used, which may for example include lighter weight sides in view of the structural rigidity of the stacked suspension packages 10, 110.

The function of the collapsible container 200 is to provide protection against dirt, water and other contaminants and some degree of puncture protection. The side panels 202 are hinged to allow the enclosure 200 to be readily moved from the operational or open position of FIG. 12 to the collapsed or storage position of FIG. 13 and vice versa. Preferably, the enclosure 200 is made of durable, reusable materials that are well suited for reuse and movement between the operational and the storage positions a large number (hundreds) of times.

The system and method of this invention will be described by way of example with the suspension package 10 and the enclosure 200. Of course, it should be recognized that the suspension package 110 as well as other types of suspension packages can be used in the system and method of this invention.

Figure 3:
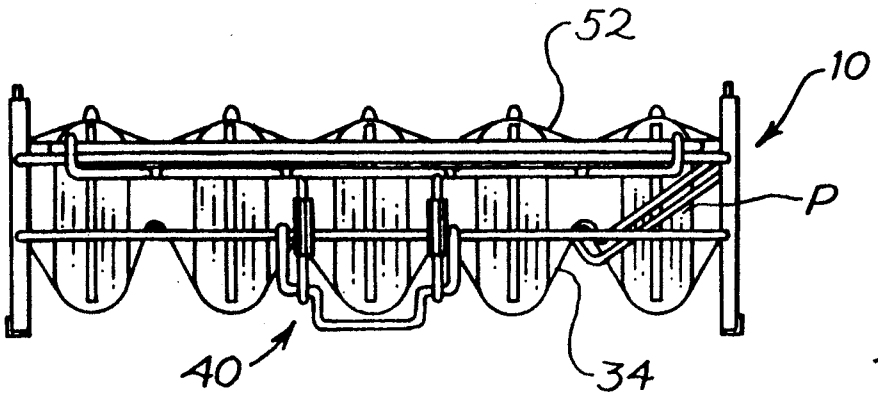
FIG. 3 is a front view of the suspension package of FIG. 1 showing the upper portion in the closed position.

As a first step in this system and method, the suspension package 10 is placed in the operational position of FIG. 1 and the upper portion 16 is opened. Then a plurality of products P are placed on the lower suspension sheet 34 and the suspension package is closed to suspend the products P as shown in FIG. 3.

The next step is to stack the loaded suspension packages 10 in the enclosure 200 as shown in FIG. 12. Then the products P, the loaded suspension packages 10 and the loaded enclosure 200 are shipped to the intended destination. At the destination, the suspension packages 10 are unloaded from the container 200 and the products P are unloaded from the suspension packages 10. During shipment, the suspension packages 10 protect the products P against abrasion, shock and vibration as described above.

Once the suspension packages 10 have been unloaded, they are moved to the collapsed position shown in FIG. 14 and the enclosure is collapsed as shown in FIG. 13. Typically, where a shipment includes multiple enclosures 200, one or more of the enclosures 200 would be left in the operational position of FIG. 12 and loaded with approximately forty-eight of the collapsed suspension packages 10. The collapsed suspension packages and the remaining collapsed enclosures 200 are then shipped to another location (such as the starting location) for reuse.

This system minimizes the use of disposable packaging materials, because both the suspension package 10 and the enclosure 200 are formed of renewable, durable, reusable elements that have an indefinite life. Thus, all of the advantages of a suspension package are obtained, while all of the disadvantages of disposable packaging are overcome. The suspension packages 10, 110 provide reliable, reusable protection for products which can individually weigh up to fifty pounds or more. The products are protected against shock, abrasion, vibration and puncture. The suspension packages 10 are readily adapted to products of differing sizes and shapes, and the packages 10 can be loaded safely, easily and efficiently. The number of separate pieces has been minimized and the loading techniques are non-complicated and easily learned and performed.

The system provides effective space utilization, both in the loaded and unloaded configurations. In the system described above, five products are stored per suspension package, eighteen suspension packages are stored per enclosure, and there is a 3:1 space reduction in the unloaded storage state as compared to the loaded operational state. Because the suspension sheets are transparent, it is easy to inspect the loaded products for identification and tracing.

The system and method described above are environmentally sound in that they minimize the use of disposable or limited life material such as corrugated board. All the materials used in the embodiments described above can be selected to be easily recycled, and they should be selected to provide maximum reusability such that they can easily be renewed or repaired without special tools. The preferred design can readily be renewed, cleaned and repaired for extended reuse on site.

Those skilled in the art will recognize that a wide variety of materials and configurations can be used to adapt the present invention for specific applications. As described above, a film such as polyurethane has been found suitable for the suspension sheets, and steel rods and channels can be used to fabricate the frames 12, 112. Other suitably rigid and tough materials including plastic materials may be substituted if desired. Also, a variety of other modifications can be made to the preferred embodiments described above. For example, the upper portions 16, 116 can readily be made in multiple, separately hinged parts to allow individual ones of the bays 32, 132 to be opened without opening all of the bays at once. Of course, the packages 10, 110 can readily be modified to provide a greater or lesser number of bays, and details of bracing and reenforcement can be modified as desired.

It is therefore intended that the foregoing detailed description be regarded as illustrative rather than limiting, and that it be understood that it is the following claims, including all the equivalents, which are intended to define the scope of this invention.

We claim:

1. A suspension package comprising:

a frame comprising a lower portion and an upper portion;

said lower portion comprising a plurality of spacer elements and at least one bay defining element hingedly mounted to the spacer elements to move between an operational position, in which the spacer elements extend away from the bay defining element to create a product receiving space, and a storage position, in which the spacer elements extend generally alongside the bay defining element;

said bay defining element defining a plurality of bays and comprising at least one lower flexible suspension sheet that extends across the bays to define a product receiving area in each bay when the spacer elements are in the operational position;

said upper portion comprising at least one upper flexible suspension sheet, and said upper portion movable between an open position, in which at least one of the bays is exposed to allow a product to be inserted into and removed from the bay, and a closed position, in which the upper and lower suspension sheets are positioned to suspend the product within the frame; and a tensioning device secured to the frame to releasably hold the upper portion in the closed position and to tension the suspension sheets around the product.

2. The invention of claim 1 further comprising a hinge mechanism mounted between the upper and lower portions to allow the upper portion to move between the open and closed positions while allowing movement of the frame lower portion to the storage position.

3. The invention of claim 2 wherein the hinge mechanism defines a first hinge axis, wherein the spacer elements and the bay defining element define a second hinge axis, and wherein the first and second hinge axes are substantially parallel to one another.

4. The invention of claim 2 wherein the hinge mechanism defines a first hinge axis, wherein the spacer elements and the bay defining element define a second hinge axis, and wherein the first and second hinge axes are substantially orthogonal to one another.

5. The invention of claim 1 wherein the upper portion supports the upper suspension sheet adjacent each side of each of the bays.

6. The invention of claim 1 wherein the spacer elements and the bay defining element comprise respective rods.

7. The invention of claim 6 wherein the rods are metallic.

8. The invention of claim 1 wherein the tensioning device comprises an over center latching linkage.

9. The invention of claim 1 wherein the at least one upper suspension sheet comprises a plurality of upper suspension sheets, each positioned over a respective one of the bays, and each defining first and second ends, wherein the first and second ends both extend below an uppermost edge of the respective upper suspension sheet when the upper portion is in the closed position, such that the lower suspension sheet supports the product on two sides and a bottom portion of the bay and the upper suspension sheet supports the product on two ends and a top portion of the bay.

10. The invention of claim 9 further comprising a plurality of hinges mounted between the upper and lower portions, wherein the first ends of the upper suspension sheets are secured to the lower portion beneath the hinges, and wherein the second ends of the upper suspension sheets are secured to a lip of the upper portion that extends below the uppermost edge of the respective upper suspension sheet when the upper portion is in the closed position.

11. The invention of claim 10 wherein the lip is hinged to a central part of the lower portion.

12. The invention of claim 1 wherein each of the spacer elements defines an upper end and a lower end, and wherein the upper and lower ends comprise protruding and recessed interlocking elements, said interlocking elements configured to interlock with similar elements of a similar suspension package to allow said similar suspension package to be stacked on said first mentioned suspension package.

13. The invention of claim 1 wherein the tensioning device comprises a length adjusting device that allows suspension sheet tension to be adjusted.

14. A suspension package comprising:

a frame comprising a lower portion and an upper portion;

said lower portion comprising four corner posts and at least two side bars hingedly mounted to the corner posts to move between an operational position, in which the corner posts are oriented transverse to the side bars to create a product receiving space, and a storage position, in which the corner posts extend generally alongside first and second ones of the side bars;

said lower portion further comprising a plurality of transverse bars extending between the first and second side bars to define a plurality of bays, and at least one lower flexible suspension sheet that extends across the lower portion to define a product receiving area in each bay when the corner posts are in the operational position;

said upper portion comprising a plurality of upper side bars, a plurality of upper transverse bars extending across an opposed pair of the upper side bars, and at least one upper flexible suspension sheet mounted to selected ones of the upper bars;

a hinge mounted between the upper and lower portions to permit movement of the upper portion between an open position, in which at least one of the bays is exposed to allow a product to be inserted into and removed from the bay, and a closed position, in which the upper and lower suspension sheets are positioned to suspend the product in the frame; and a tensioning device secured to the frame to releasably hold the upper portion in the closed position and to tension the suspension sheets around the product.

15. The invention of claim 14 wherein the hinge defines a first hinge axis, wherein the corner posts and the side bars define a second hinge axis, and wherein the first and second hinge axes are substantially orthogonal to one another.

16. The invention of claim 14 wherein the corner posts, side bars, and transverse bars comprise respective rods.

17. The invention of claim 16 wherein the rods are metallic.

18. The invention of claim 14 wherein the tensioning device comprises an overcenter latching linkage.

19. The invention of claim 14 wherein each of said corner ports defines an upper end and a lower end, and wherein the upper and lower ends comprise protruding and recessed interlocking elements, said interlocking elements configured to interlock with similar elements of a similar suspension package to allow said similar suspension package to be stacked on said first mentioned suspension package.

20. A suspension package comprising:

a frame comprising a lower portion and an upper portion;

said lower portion comprising four corner posts, at least two side bars, and a plurality of transverse bars, said side bars and transverse bars cooperating to form a bay defining element hingedly mounted to the corner posts to move between an operational position, in which the corner posts are oriented transverse to the transverse bars to create a product receiving space, and a storage position, in which the corner posts extend generally alongside the bay defining element; said transverse bars extending between the side bars to define a plurality of bays;

at least one lower flexible suspension sheet that extends across the lower portion to define a product receiving area in each bay when the corner posts are in the operational position;

said upper portion mounted to the lower portion by a hinge mechanism configured to permit movement of the upper portion between an open position, in which at least one of the bays is exposed to allow a product to be inserted into and removed from the bay, and a closed position, in which the upper portion is adjacent to the lower portion;

said upper portion comprising a plurality of flexible upper suspension sheets, each positioned over a respective one of the bays to suspend the product in the respective bay when the upper portion is in the closed position; and a tensioning device secured to the frame to releasably hold the upper portion in the closed position and to tension the suspension sheets around the product.

21. The invention of claim 20 wherein the hinge mechanism defines a first hinge axis, wherein the corner posts and the pair of transverse bars define a second hinge axis, and wherein the first and second hinge axes are substantially parallel to one another.

22. The invention of claim 20 wherein the corner posts, side bars, and transverse bars comprise respective rods.

23. The invention of claim 22 wherein the rods are metallic.

24. The invention of claim 20 wherein the tensioning device comprises an overcenter latching linkage.

25. The invention of claim 20 wherein each of the upper suspension sheets defines first and second ends, wherein the first and second ends both extend below an uppermost edge of the respective upper suspension sheet when the upper portion is in the closed position, such that the lower suspension sheet supports the product on two sides and a bottom portion of the bay and the upper suspension sheet supports the product on two ends and a top portion of the bay.

26. The invention of claim 25 wherein the first ends of the upper suspension sheets are secured to the lower portion beneath the hinge mechanism, and wherein the second ends of the upper suspension sheets are secured to a lip of the upper portion that extends below the uppermost edge of the respective upper suspension sheet when the upper portion is in the closed position.

27. The invention of claim 26 wherein the lip is hinged to a central part of the lower portion.

28. The invention of claim 20 wherein each of said corner ports defines an upper end and a lower end, and wherein the upper and lower ends comprise protruding and recessed interlocking elements, said interlocking elements configured to interlock with similar elements of a similar suspension package to allow said similar suspension package to be stacked on said first mentioned suspension package.

29. A reusable, returnable suspension package system comprising:

a collapsible enclosure that is movable between an operational position, in which the enclosure defines an internal volume, and a storage position, in which the enclosure is collapsed to reduce shipping volume;

a plurality of suspension packages disposed in the enclosure, each of said suspension packages comprising:

a frame that is movable between an operational position, in which the frame defines at least one product receiving volume, and a storage position, in which the frame is collapsed to reduce shipping volume, said frame comprising first and second portions;

at least one flexible suspension sheet secured to the frame;

said first portion movable between an open position, in which the suspension sheet is exposed to allow a product to be placed on the suspension sheet, and a closed position, in which the at least one suspension sheet is tensioned to suspend the product within the frame; and a tensioning device secured to the frame to releasably hold the first portion in the closed position and to tension the suspension sheet.

30. The invention of claim 29 wherein each of said suspension packages is formed of durable, reusable materials and is well suited for reuse and movement between the operational and the storage position a large number of times.

31. The invention of claim 30 wherein said enclosure is formed of durable, reusable materials and is well suited for reuse and movement between the operational and the storage positions a large number of times.

32. The invention of claim 31 wherein the frame of each of the suspension packages comprises metal rods.

33. The invention of claim 29 wherein the first and second portions are hinged together.

34. The invention of claim 33 wherein the at least one suspension sheet comprises a first sheet secured to the first portion and a second sheet secured to the second portion.

35. The invention of claim 34 wherein the frame defines a plurality of bays, each shaped to receive a respective product.

36. A method of shipping products and recycling shipping materials comprising the following steps:

a) placing a plurality of products in a plurality of suspension packages, each of said suspension packages comprising:

a frame that is movable between an operational position, in which the frame defines at least one product receiving volume, and a storage position, in which the frame is collapsed to reduce shipping volume, said frame comprising first and second portions;

at least one flexible suspension sheet secured to the frame;

said first portion movable between an open position, in which the suspension sheet is exposed to allow a product to be placed on the suspension sheet, and a closed position, in which the at least one suspension sheet is tensioned to suspend the product within the frame; and a tensioning device secured to the frame to releasably hold the first portion in the closed position and to tension the suspension sheet;

b) operating the tensioning devices to suspend the products in the suspension packages;

c) loading the suspension packages and the products suspended therein in a collapsible enclosure that is movable between an operational position, in which the enclosure defines an internal volume, and a storage position, in which the enclosure is collapsed to reduce shipping volume;

d) shipping the collapsible enclosure and the suspension packages loaded therein to a first location; then e) removing the suspension packages from the collapsible enclosure and removing the products from the suspension packages; then f) collapsing the enclosure and the suspension packages to the storage positions; and then g) shipping the collapsed enclosure and suspension packages to a second location for reuse.

37. The method of claim 36 wherein each of said suspension packages is formed of durable, reusable materials and is well suited for reuse and movement between the operational and the storage position a large number of times.

38. The method of claim 37 wherein said enclosure is formed of durable, reusable materials and is well suited for reuse and movement between the operational and the storage positions a large number of times.

39. The method of claim 38 wherein the frame of each of the suspension packages comprises metal rods.

40. The method of claim 36 wherein the first and second portions are hinged together.

41. The method of claim 40 wherein the at least one suspension sheet comprises a first sheet secured to the first portion and a second sheet secured to the second portion.

42. The method of claim 41 wherein the frame defines a plurality of bays, each shaped to receive a respective product.

43. In a suspension package of the type comprising: a frame comprising upper and lower portions, at least one suspension sheet positioned across the frame to suspend a product, and a tensioning device secured to the frame to releasably hold the upper portion in position to tension the suspension sheet around the product, the improvement comprising:

a preformed aperture in the suspension sheet positioned to receive a protruding portion of the product and thereby to protect the protruding portion from applied suspension forces transmitted by the suspension sheet.

44. The invention of claim 12 wherein the protruding interlocking elements are spring biased to an extending position.

45. The invention of claim 12 wherein the protruding interlocking elements each define a cushioning flange adjacent an end of the respective spacer.

* * * * *